US005158194A

United States Patent [19]

Sirgo et al.

[11] Patent Number: 5,158,194

[45] Date of Patent: Oct. 27, 1992

[54] SAFETY CLOSURE WITH EASY-OPEN FEATURE FOR HANDICAPPED AND ELDERLY INDIVIDUALS

[75] Inventors: Mark A. Sirgo, Chapel Hill, N.C.; Robert M. Wygant, Richland, Mich.; Charles F. Woodward, Kalamazoo, Mich.; Paul V. Engelmann, Plainwell, Mich.

[73] Assignee: Glaxo Inc., Research Triangle Park, N.C.

[21] Appl. No.: 693,680

[22] Filed: Apr. 30, 1991

[51] Int. Cl.[5] ..... B65D 55/02

[52] U.S. Cl. ..... 215/219; 215/215; 215/217; 215/302; 215/305

[58] Field of Search ..... 215/215, 302, 219, 218, 215/217, 216, 305

[56] References Cited

U.S. PATENT DOCUMENTS

| | | | |
|---|---|---|---|
| 2,921,705 | 1/1960 | Dorsey | 215/215 |
| 3,394,830 | 7/1968 | Schiavo | 215/219 X |
| 3,857,505 | 12/1974 | Mumford et al. | 215/9 |
| 3,888,375 | 6/1975 | Gerk | 215/219 |
| 4,098,417 | 7/1978 | Bennett | 215/204 |
| 4,141,461 | 2/1979 | LaChance | 220/253 |
| 4,378,073 | 3/1983 | Luker | 215/305 X |
| 4,500,006 | 2/1985 | Lafortune et al. | 215/305 X |
| 4,731,512 | 3/1988 | Barriac | 215/220 |

*Primary Examiner*—Stephen Marcus
*Assistant Examiner*—Paul A. Schwartz
*Attorney, Agent, or Firm*—Richard E. Jenkins

[57] ABSTRACT

A child-resistant, two-piece closure is formed with a resilient wedge in the outer cap member which can be pressed into interlocking relationship with an upstanding locking lug element of the inner cap member to facilitate rotational movement in the closure loosening direction by a healthy adult. An aperture is provided in the outer cap member so that a pencil may be radially inserted therein and into contact with the upstanding locking lug element so as to interlockingly couple the outer cap member and inner cap member for rotational movement in the closure loosening direction with the pencil by an elderly or handicapped individual. The child-resistant closure serves as a duel function device by allowing push-in and turn closure removal by healthy adults and easy removal with an inserted pencil or the like by elderly or handicapped adults while still being resistant to removal by young children.

22 Claims, 9 Drawing Sheets

SAFETY CLOSURE WITH EASY-OPEN FEATURE FOR HANDICAPPED AND ELDERLY INDIVIDUALS

TECHNICAL FIELD

The present invention relates to closures for containers, and more particularly the invention relates to an improved child-resistant safety closure with an easy-open feature for the handicapped and elderly.

RELATED ART

Since the passage of the Poison Prevention Packaging Act of 1970, the use of child-resistant caps or closures for containers for medicine or other products which might be dangerous to small children has become commonplace. The use of the child-resistant closures for containers has served to reduce fatal and serious injuries from accidental poisonings of children due to a wide variety of articles including prescription and non-prescription pharmaceutical drugs.

Typical of the child-resistant closure structures mandated by the Act is the "push-down and turn" cap or closure disclosed in U.S. Pat. No. 3,857,505 to Mumford et al. This patent discloses a plastic outer cap with lugs that are caused to interact with the lugs of the inner cap by pressing down on the outer cap until the lugs engage. Rotation of the outer cap in the closure loosening direction will then result in unthreading of the entire cap or closure from a container. Many other types of similar child-resistant closure structures are well-known to those skilled in the child-resistant closure art.

Unfortunately, although child-resistant closures have been effective in reducing the incidence of injury and death in young children due to accidental poisoning, the child-resistant closures have been found to be very difficult to open for handicapped and elderly individuals. For example, it is well-known that many individuals with arthritis cannot physically open a child-resistant closure. This is due primarily to the fact that presently known child-resistant closures primarily rely upon a perceived difference in strength between children and adults and require an adult's is many times impossible for the handicapped and elderly adults who have lost physical strength to open conventional child-resistant closures. The unfortunate consequence is that many times the handicapped and elderly will either not use or will replace the child-resistant closure with a standard container cap so as to obviate the advantages ostensibly provided by the federally mandated closures.

This problem has been recognized to some degree by prior art closures such as disclosed in U.S. Pat. No. 4,731,512 to Berriac. This patent discloses a press-down-and-twist child-resistant cap with an easy-open feature for the manually handicapped wherein lugs, ribs or channels are provided on the top surface of the outer cap. This facilitates engaging the edge of a table or drawer with the outer cap so that the bottle may be pushed axially against the cap and then rotated to effect removal of the cap assembly by the manually handicapped. Several embodiments are shown in the patent including one wherein a pencil is wedged between two lugs in the top surface of the outer cap and a downward force applied thereon so that the other hand of the user can then rotatably loosen the container from the child-resistant cap assembly. Unfortunately, this type of closure as well as other child-resistant closures known to applicant which attempt to address this problem fall short of a practical solution since they are either unduly complex, impractical in use, and/or require too much effort and coordination from the handicapped or elderly user. Thus, a truly practical and easy-to-use child-resistant closure with an easy-open feature for the handicapped and elderly has yet to be discovered and made commercially available.

This is now particularly important since the Consumer Product Safety Commission has recently proposed to amend its requirements under the Poison Prevention Packaging Act of 1970 for child-resistant packaging of certain household substances. The proposed rules (Federal Register, Volume 55, No. 194, Oct. 5, 1990) will substitute a panel of 100 older adults ranging in age from 60 to 75 years for the current panel of 18 to 45 year old adults. The Commission believes that substituting a panel of older adults will exclude the more difficult-to-use child-resistant closure designs that now can pass the test with the younger panel. Thus, the proposed amendments are intended to simplify the testing procedure so as (1) to exclude difficult-to-use designs and (2) to reduce the time required for adults to open the child-resistant closure. Applicant's improved safety closure is intended to conform to the stricter requirements of the proposed amendments as well as to provide a significant advancement in the child resistant closure art.

DISCLOSURE OF THE INVENTION

In accordance with the present invention, applicant provides an improved child-resistant or safety closure with easy opening capability for the handicapped and elderly. The child-resistant closure for containers having an externally threaded top portion includes the following elements: (a) An inner cap member having a top surface and an annular depending skirt with internal threads defined thereby for threadingly engaging the top portion of the container, the top surface of said inner cap member defining at least one upstanding locking lug element in the medial portion thereof and a plurality of drive lug elements positioned radially outwardly from said locking lug element and circumferentially spaced-apart; and (b) An outer cap member having a top and an annular depending skirt loosely encompassing said inner cap member and being normally freely rotatable relative thereto in the closure loosening direction, the top of said outer cap member defining a plurality of inwardly extending drive finger elements adapted to slide over said drive lug elements when said outer cap member is rotated in the closure loosening direction and to engage said drive lug elements when said outer cap member is rotated in the closure tightening direction, and a resilient integral wedge element adapted to be pushed inwardly so as to interlockingly engage said upstanding locking lug element of said inner cap member and to thereby permit rotation of said coupled inner and outer cap members in the closure loosening direction, said top of said outer cap further defining an aperture therein radially spaced-apart from said upstanding locking lug element so that when said outer and inner cap members are relatively rotated to a predetermined alignment one end of an elongate implement such as a pencil may be inserted through said aperture in a direction substantially perpendicular to said closure axis and into contact with said upstanding locking lug element so as to interlockingly couple said outer and inner cap members to facilitate rotation thereof in the closure loosening direction with the other end of the elongate implement.

It is therefore the object of this invention to provide a child-resistant closure which eliminates the problems described hereinabove.

More specifically, it is the object of this invention to provide a child-resistant closure which is adapted for easy opening by handicapped and elderly individuals.

It is another object of the present invention to provide a child-resistant closure adapted for easy opening by handicapped and elderly individuals and which also is easier to open for healthy adults.

It is yet another object of the present invention to provide a child-resistant closure which does not utilize a push-down and turn configuration but in lieu thereof utilizes a push-in and turn closure feature for enhanced performance with healthy adults.

It is still another object of the present invention to provide a child-resistant closure which may be easily loosened and opened by handicapped and elderly individuals by insertion of a pencil or the like therein and rotation of the free end of the pencil or the like in the closure loosening direction.

Some of the objects of the invention having been stated, other objects will become evident as the description proceeds, when taken in connection with the accompanying drawings.

BEST MODE FOR CARRYING OUT THE INVENTION

Figure 1:
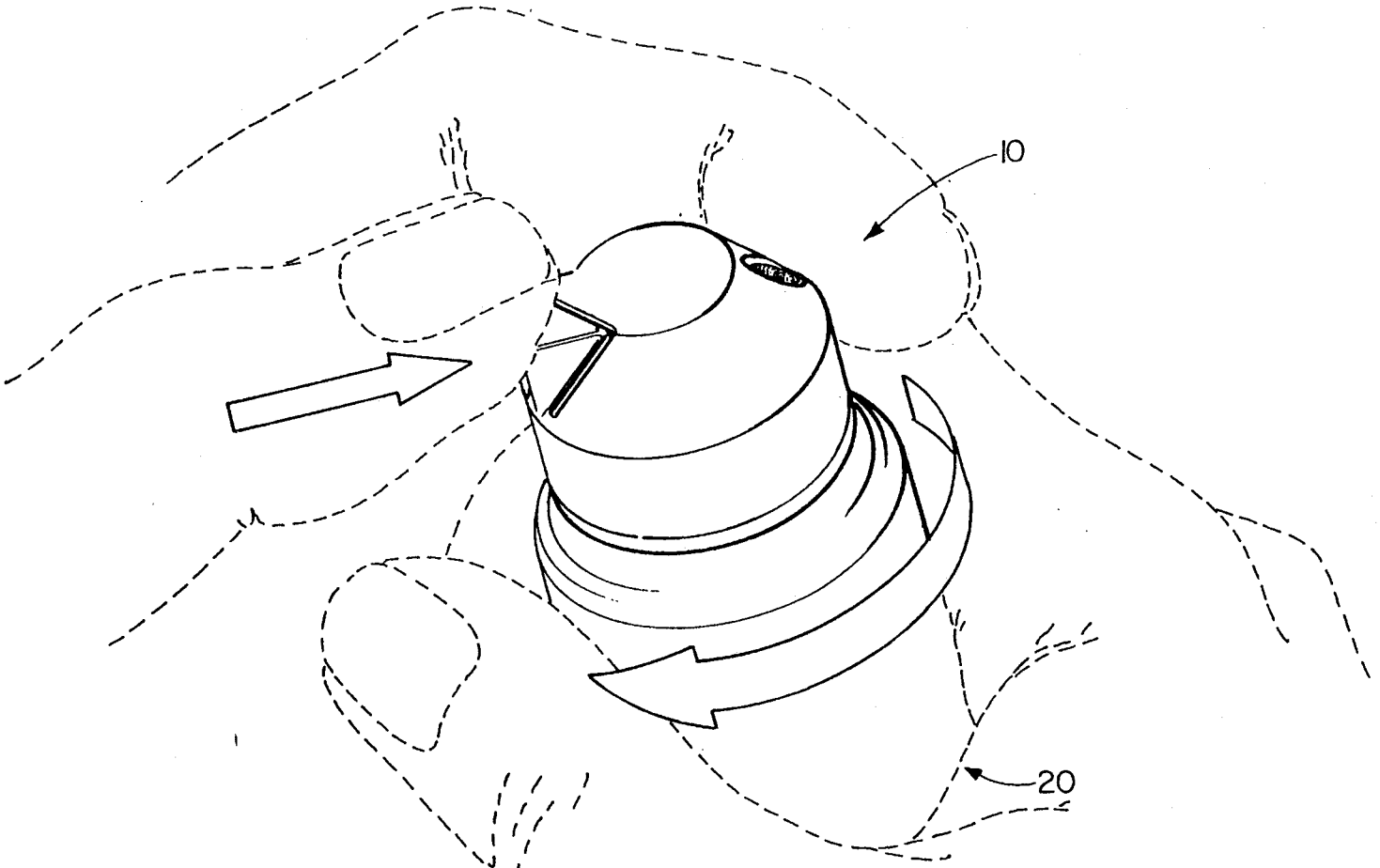
FIG. 1 is a perspective view of the manner of manipulating a container and the safety closure of the invention by a healthy adult to effect removal of the safety closure.

Referring now more specifically to the drawings, a preferred embodiment of a safety closure with easy-open feature for the elderly and handicapped according to the present invention is shown in the drawings and generally designated 10. Closure 10 may be utilized with substantially any type of conventional bottle or container fabricated from plastic, glass, or other suitable material and generally designated 20 in the drawings. Container 20 is provided with external screw threads 22 around the top portion and/or neck thereof which are most suitably right hand screw threads so that clockwise rotation of closure 10 will serve to tighten the closure onto container 20 and counter-clockwise rotation of closure 10 will serve to loosen the closure from container 20.

The structure of closure 10 will be described in detail hereinbelow in order to provide an appreciation of its dual function of providing a child-resistant closure which (1) may be easily removed by a healthy adult with a push-in and turn procedure requiring an adult's strength and (2) may be easily removed by utilizing a pencil or other similar linear element in order to allow an elderly or handicapped adult to remove and resecure closure 10. Closure 10 is believed to meet all existing requirements of the Poison Prevention Packaging Act of 1970 as well as the newly-proposed amendments for greater ease of use by senior adults as proposed by the Consumer Product Safety Commission (Federal Register, Volume 55, No. 194, Oct. 5, 1990).

Figure 3:
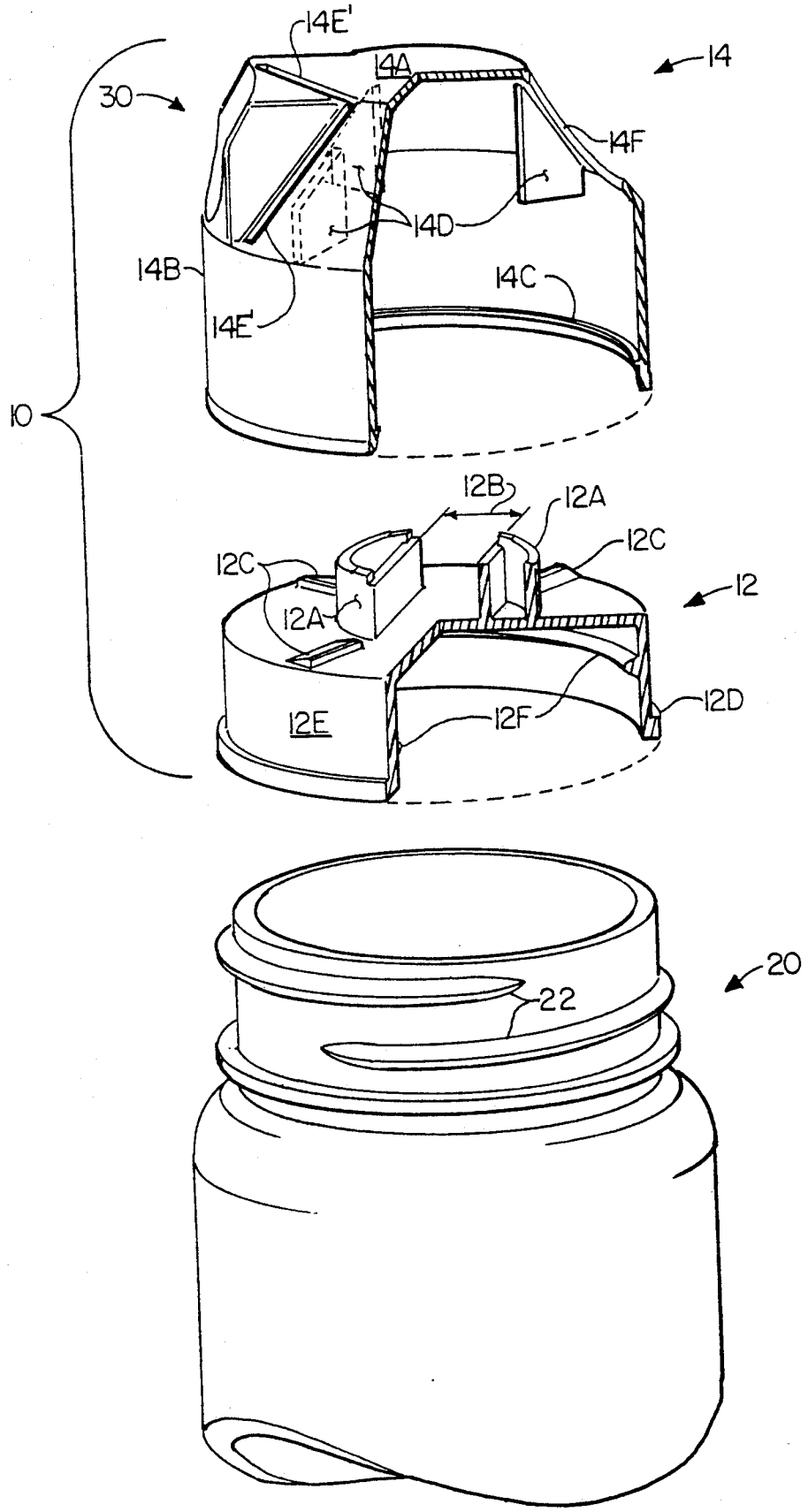
FIG. 3 is an exploded view of the safety closure of the invention and a representative container upon which the safety closure is threadingly secured.
Figure 3A:
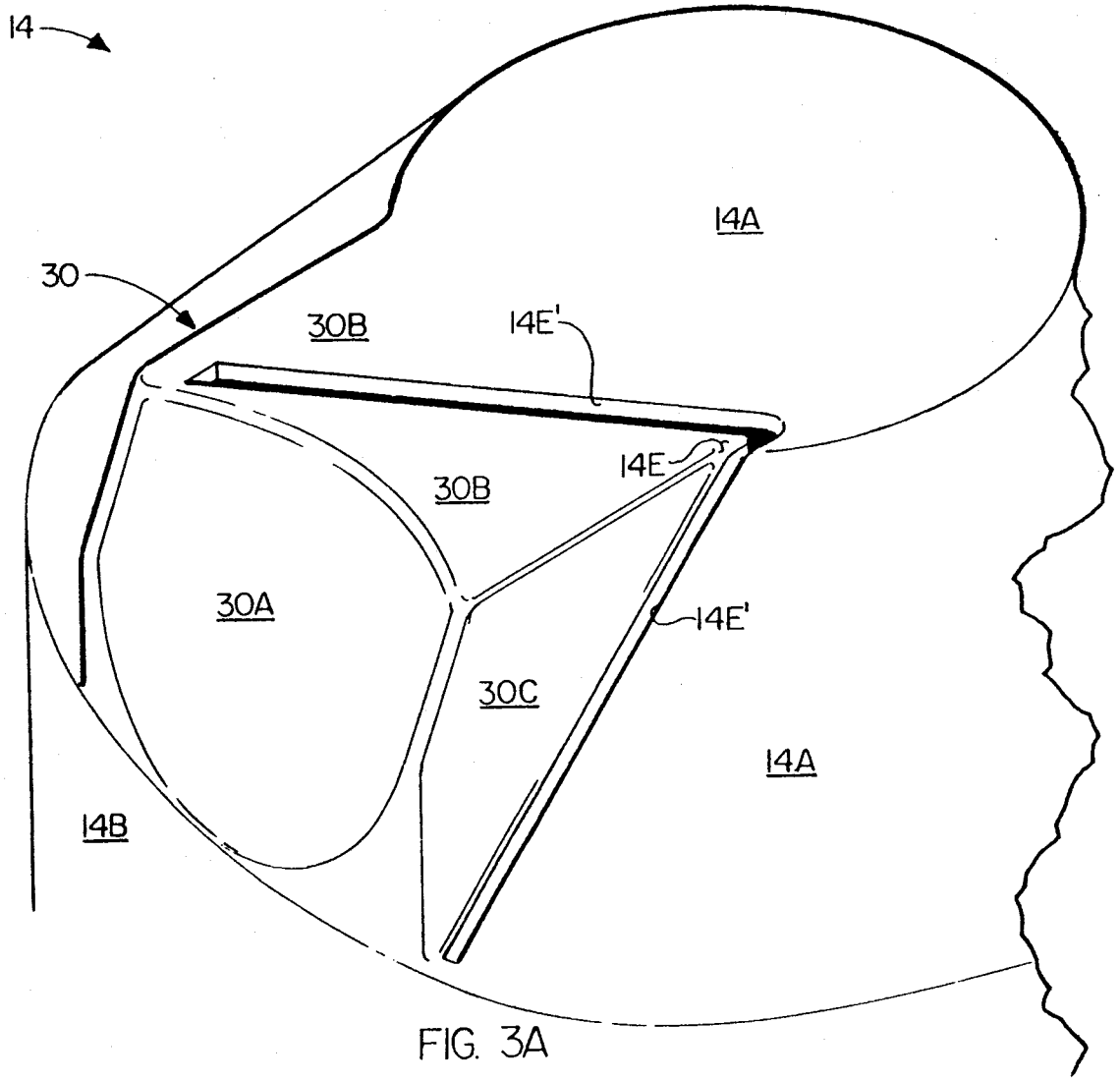
FIG. 3A is an enlarged fragmentary view of the wedge defining section of the outer cap member of the safety closure.
Figure 4C:
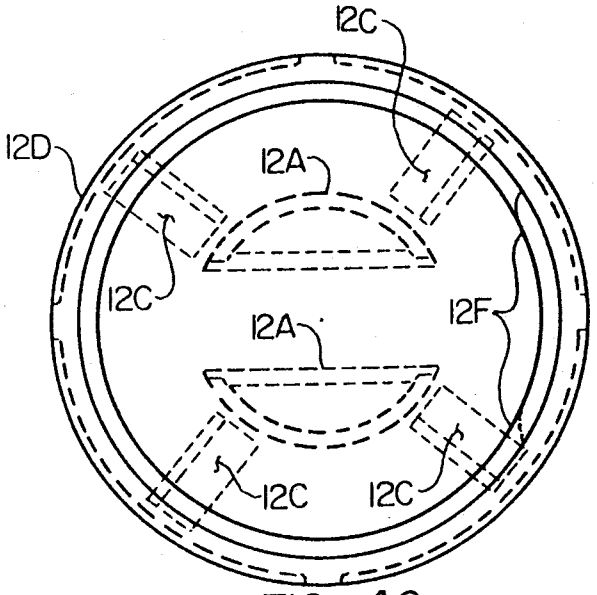
FIGS. 4A–4D are front elevation, top plan, bottom plan, and side elevation views, respectively, of the inner cap member of the safety closure of the invention.
Figure 4D:
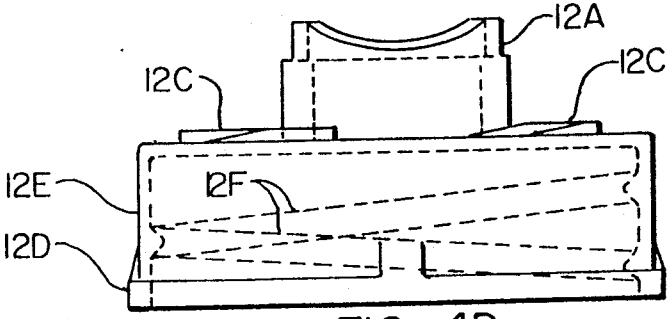
Figure 4B:
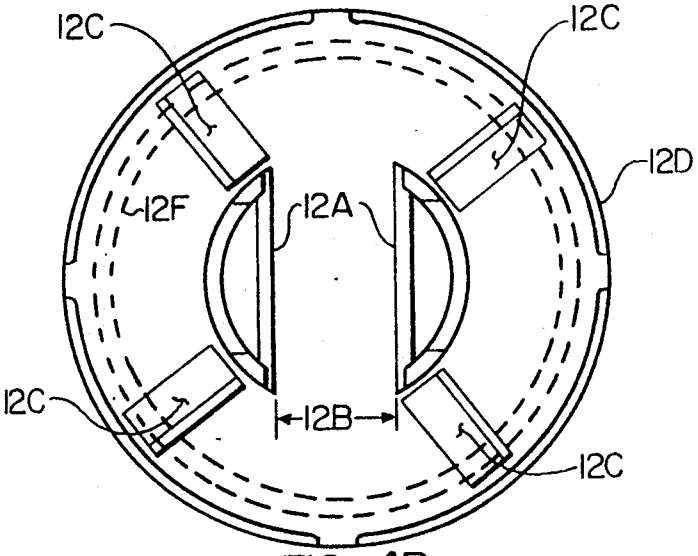
Figure 4A:
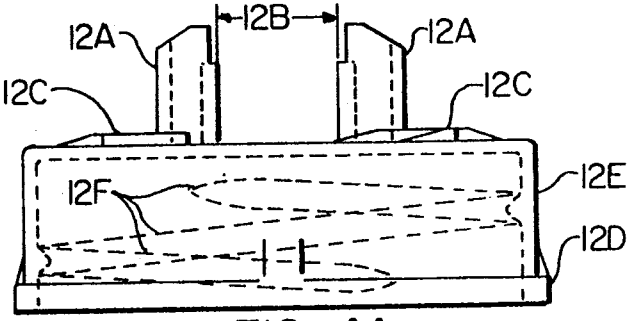
Figure 5C:
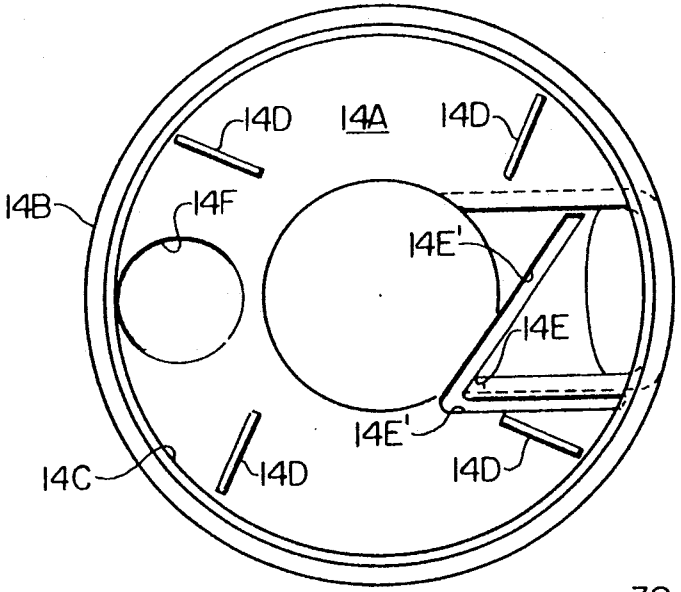
FIGS. 5A–5D are front elevation, top plan, bottom plan, and side elevation views, respectively, of the outer cap member of the safety closure of the invention.
Figure 5D:
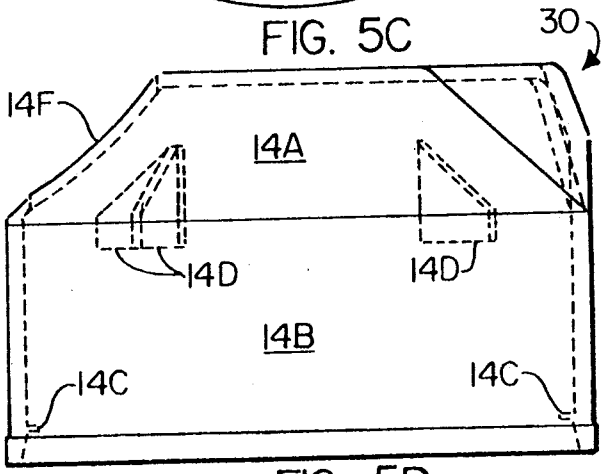
Figure 5B:
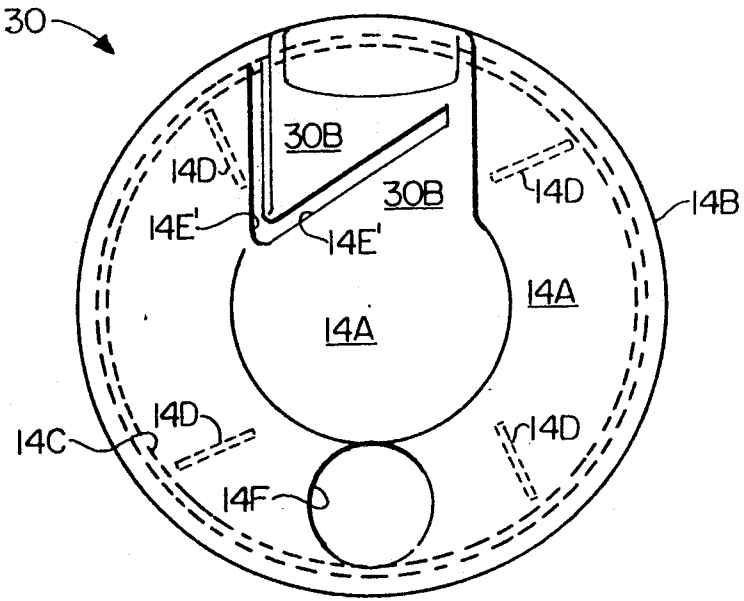
Figure 5A:
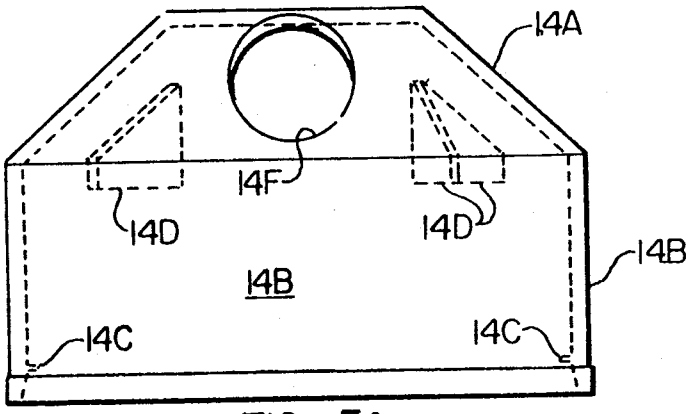

With particular reference now to FIGS. 3–5 of the drawings, closure 10 of the present invention is formed of two components: an inner cap member 12 and an outer cap member 14. Although these components may be made of any suitable material, most suitably inner cap member 12 is made from a thermoplastic material such as polyethylene or polypropylene, and outer cap member 14 is made from a relatively more rigid plastic material. In another alternative, of course, both inner cap member 12 and outer cap member 14 could be formed from conventional rigid plastic well known to those skilled in the closure art.

Figure 6:
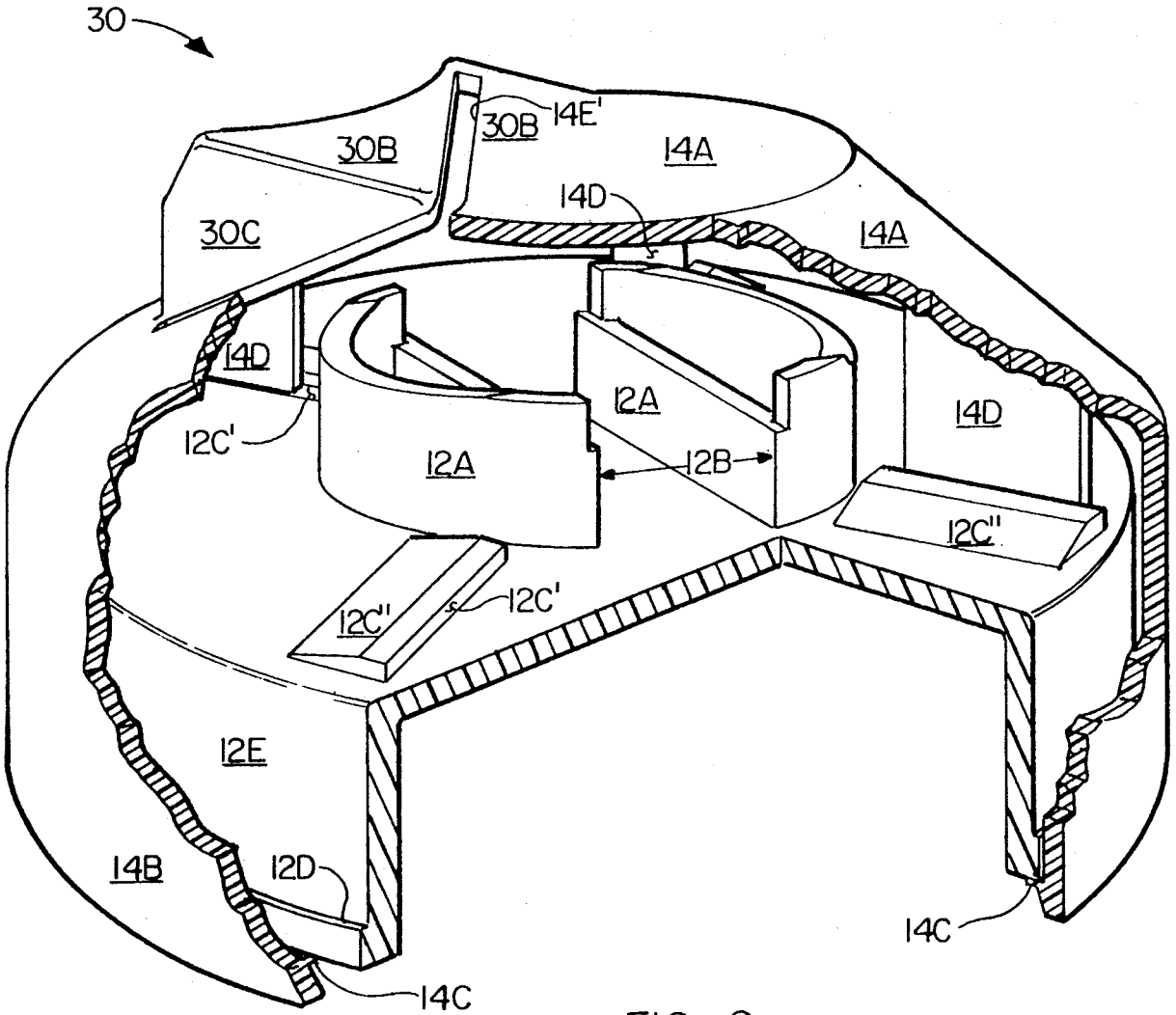
FIG. 6 is a perspective view, with parts cut away, of the safety closure of the invention with the outer cap member in freely rotatable relationship with the inner cap member.
Figure 7:
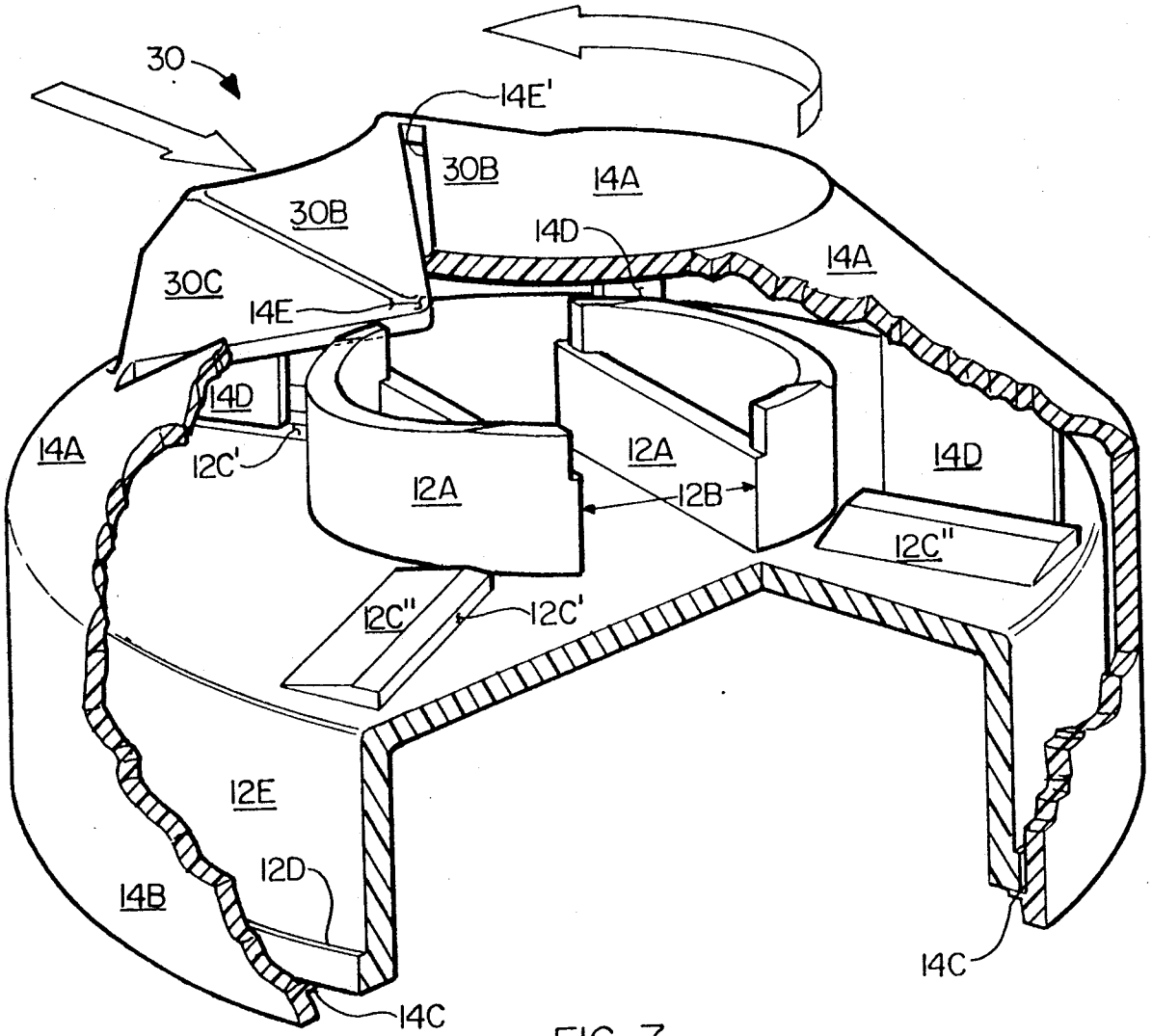
FIG. 7 is a perspective view, with parts cut away, of the safety closure of the invention with the resilient wedge of the outer cap member pushed into interlocking relationship with an upstanding locking lug element of the inner cap member for rotation of the closure in the closure loosening direction.
Figure 8:
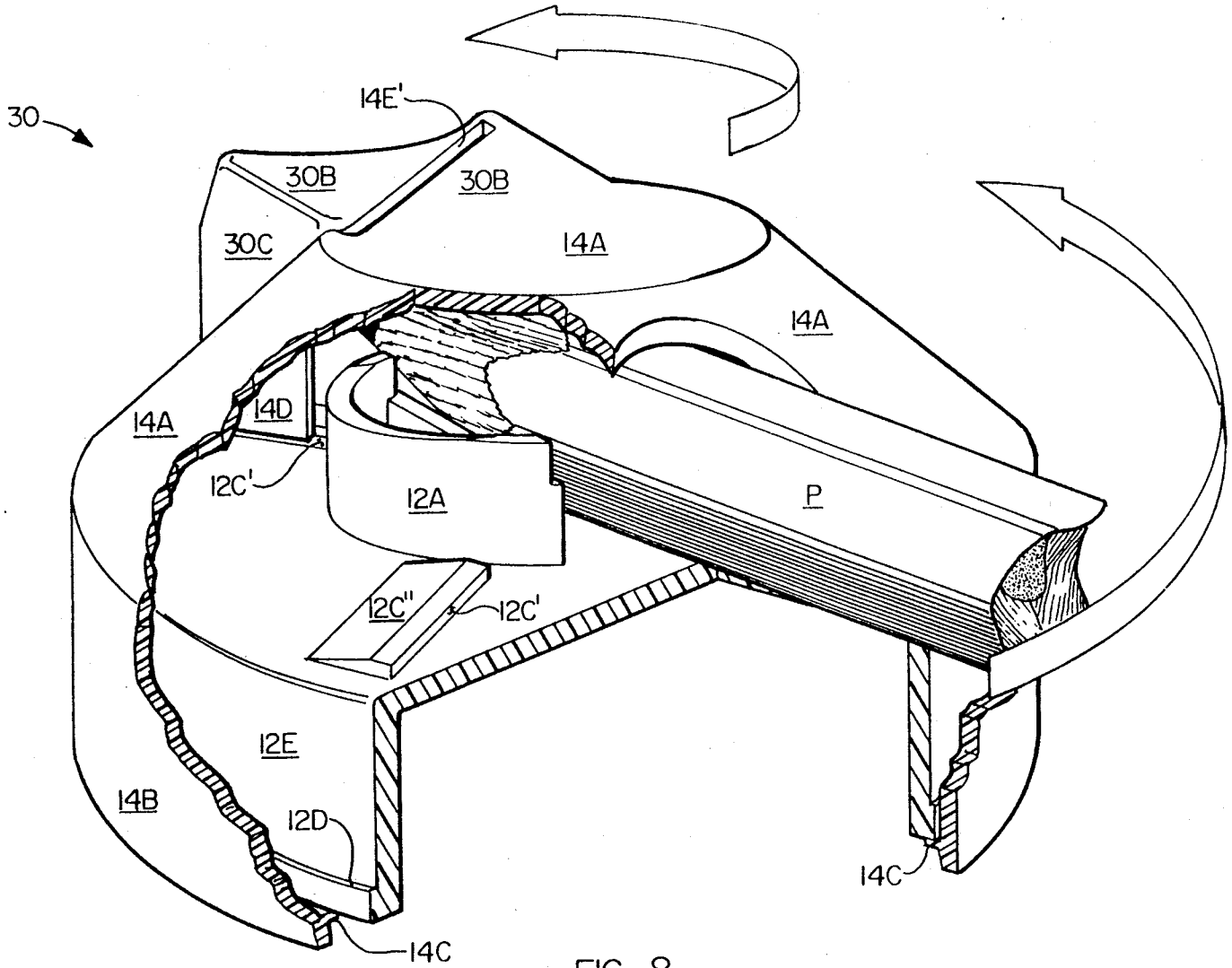
FIG. 8 is a perspective view, with parts cut away, of the safety closure of the invention with a pencil inserted through the aperture of the outer cap member and into the passageway defined between the upstanding locking lug elements of the inner cap member so as to interlockingly couple the outer cap member and inner cap member for rotation of the closure in the closure loosening direction.

Inner cap member 12 is preferably made as an integral unit and includes two upstanding locking lug elements 12A which define an elongate passageway 12B therebetween. Upstanding locking lug elements 12A are radially offset from the center of the top surface of inner cap member 12, and passageway 12B extends across the center of the top surface of inner cap member 12 (as best seen in FIGS. 3 and 4). Inner cap member 12 also includes four drive lug elements 12C which are circumferentially spaced-apart around the top surface thereof. With particular reference to FIGS. 6–8, it can be seen that drive lug elements 12C define a vertical wall 12C' along the length of one side thereof and an inclined wall 12C" along the length of the opposing side thereof. In the preferred embodiment of the invention, vertical side 12C' is positioned so as to be the leading side of drive lug element 12C when inner cap member 12 is rotated in the counterclockwise direction and inclined side 12C" is the trailing side. As will be explained in more detail hereinbelow, this allows outer cap member 14 (which telescopically fits over inner cap member 12) to freely turn relative to inner cap member 12 when rotated in the counterclockwise closure loosening direction. Outer cap member 14 will, however, couple with inner cap member 12 so as to tighten closure 12 on a container when outer cap member 14 is rotated in the clockwise closure tightening position. Thus, young children tampering with container 20 having closure 10 thereon will only be able to tighten closure 10 onto container 20 due to the "freewheeling" movement of outer cap member 14 when closure 10 is rotated in the closure loosening direction.

Again with reference to inner cap member 12, applicant provides a small, outwardly extending rib 12D around the bottom circumference of the depending skirt 12E thereof so that it may be pressed into and concentrically retained by outer cap member 14 while still being freely rotatable relative thereto. Skirt 12E of inner cap member 12 is internally threaded with threads 12F which are sized so as to threadingly engage external threads 22 of container 20 when inner cap member 12 is rotated in the clockwise closure tightening position thereon.

With reference again to FIGS. 3–5, outer cap member 14 is most suitably made with a frusto-conical top 14A and skirt 14B depending therefrom. Skirt 14B defines an inwardly extending shoulder 14C around the inside surface thereof which retains inner cap member 12 therein while still allowing for freely rotatable movement therebetween. Outer cap member 14 also includes four integrally formed drive finger elements 14D extending downwardly from top 14A and equidistantly spaced-apart around the circumference thereof so as to correspond and co-act with the four drive lug elements 12C of inner cap member 12. Drive finger elements 14D are sized so that when inner cap member 12 is telescopically pressed into outer cap member 14 so as to be concentrically retained therein and freely rotatable relative thereto, drive finger elements 14D will slip over corresponding drive lug elements 12C of inner cap member 12 when outer cap member 14 is rotated in the counterclockwise closure loosening direction. Thus, when outer cap member 14 of closure 10 is rotated by a child in the closure loosening direction, it merely "freewheels" and will not tend to loosen closure 10 and allow access to container 20. This is due to the relative sizing of drive finger elements 14D and corresponding drive lug elements 12C as well as to the fact that drive finger elements 14D will first contact inclined sides 12C'' of drive lug elements 12C and thereby be urged to slip over drive lug elements 12C. When outer cap member 14 is rotated in the opposite direction (clockwise closure tightening direction), drive finger elements 14D will first contact and stoppingly engage the vertical sides 12C' of drive lug elements 12C so as to prevent relative rotation of outer cap member 14 and inner cap member 12. In other words, clockwise closure tightening rotation of outer cap member 14 serves to interlock it with inner cap member 12 so as to tighten closure 10 onto container 20. Thus, a child playing with container 20 will not be able to remove closure 10 but only to further tighten it onto container 20 by rotation of outer cap member 14.

Outer cap member 14 also includes an integral resilient wedge element 14E which is defined by two linear and intersecting slots 14E' cut into a raised section thereof which can best be appreciated with reference to FIGS. 3A and 5–8. Although many different configurations for the wedge-defining section of outer cap member 14 are contemplated by applicant's inventive safety closure 10, a preferred configuration is shown in the drawings and is essentially a radial extension of the frusto-conical top 14A of outer cap member 14. A resilient wedge-defining section 30 is formed by front side 30A, top side 30B and two opposing vertical sides 30C as best seen in FIGS. 1–3 and 6–8 of the drawings. The resilient vertical wedge 14E is formed from (1) a first slot 14E' extending substantially along the juncture of one vertical side 30C of wedge-defining section 30 and the frusto-conical top 14A of inner cap member 14 and (2) a second intersecting slot 14E' extending diagonally outwardly across top side 30B of wedge-defining section 30.

In use (see FIG. 1), the thumb or other finger of the user is pressed against front side 30A of wedge-defining section 30 which serves to deflect resilient wedge element 14E inwardly and downwardly into interlocking contact with one of the upstanding locking lug elements 12A of inner cap member 12. Thus, the healthy adult desiring to remove closure 10 from container 20 merely holds closure 10 in one hand and presses front side 30A of wedge-defining section 30 inwardly so as to interlock outer cap member 14 and inner cap member 12. Then container 20 (which is most suitably being held by the other hand of the healthy adult) is rotated in the closure loosening direction so as to obtain access to the contents of container 20. Thus, although the push-in and turn construction of closure 10 does require the force of a healthy adult for proper actuation, it is particularly easy to use for such a healthy adult in contrast to conventional push-down and turn types of safety closures. FIG. 6 depicts closure 10 in a "freewheeling" normal mode, and FIG. 7 depicts closure 10 wherein resilient wedge element 14E has been pushed in to engage an upstanding locking lug element 12A of inner cap member 12 and thus to interlockingly engage outer cap member 10 and inner cap member 12 for easy removal of closure 10 by a healthy adult.

With reference again to outer cap member 14, aperture 14F can be seen to be defined by frusto-conical top 14A of outer cap member 14 in a position diametrically opposite resilient wedge-defining section 30. Aperture 14F is radially spaced-apart from the two upstanding locking lug elements 12A and the passageway 12B defined therebetween. Although aperture 14F may be of any suitable size, it is preferred that the aperture be sized so as to be slightly larger than the diameter of a conventional pencil. Aperture 14F of outer cap member 14 provides for the highly desirable dual functionality of applicant's novel closure 10.

Figure 2:
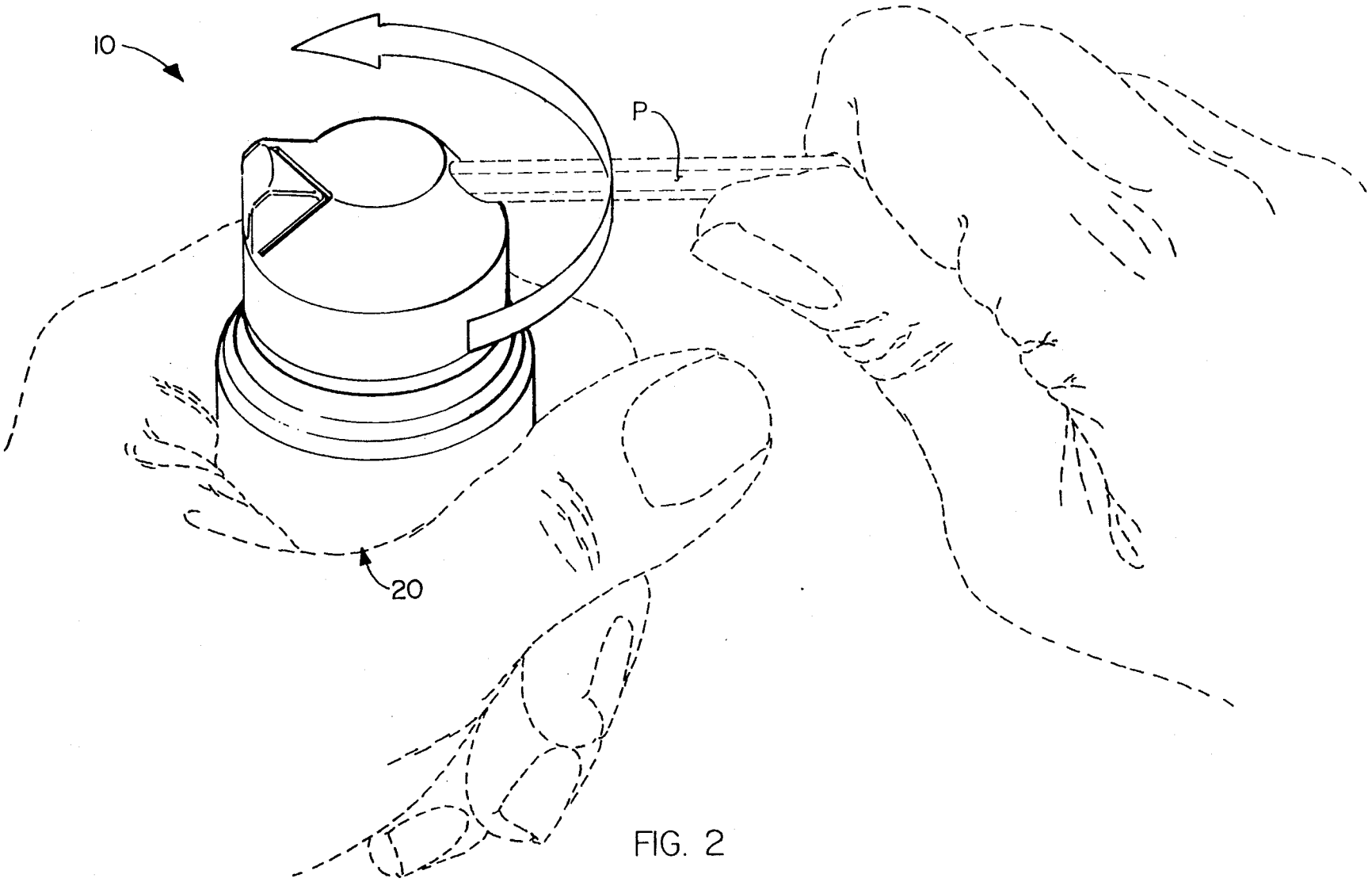
FIG. 2 is a perspective view of the manner of manipulating a container and the safety closure of the invention by a handicapped or elderly adult to effect removal of the safety closure.

As noted hereinbefore, applicant is aware of ongoing efforts by federal regulators to require safety closures to be more easily removable by elderly and handicapped individuals. Toward this end, applicant's novel safety closure serves the dual function of being (1) more easily removable by healthy adults and (2) more easily removable by elderly and handicapped adults. The latter function is facilitated by rotating aperture 14F into alignment with passageway 12B and radially inserting a pencil P into closure 10. Pencil P (see FIGS. 2 and 8) is inserted first through aperture 14F and then through passageway 12B and into contact with upstanding locking lug elements 12A so as to form an interlocking couple of outer cap member 14 and inner cap member 12. This is essentially the same function performed by pressing resilient wedge element 14E into interlocking engagement with an upstanding locking lug element 12A by a healthy adult but allows for the much easier removal of closure 10 from container 20 by merely rotating the free end of pencil P in the closure loosening direction. The elderly or handicapped person benefits from the leverage imparted by the remote end of pencil P to the interlocked inner cap member 12 and outer cap member 14 of closure 10. Thus, while holding container 20 in one hand, the elderly or handicapped individual may use pencil P to either remove closure 10 or replace closure 10 onto the top of container 20 as best shown in FIG. 2. This feature of applicant's closure provides for greater ease of removal and replacement of closure 10 by the elderly or handicapped person than any closure known to applicant. Closure 10 is believed to meet a long-felt need for a truly practical safety closure which is easy to use by both healthy adults as well as elderly and handicapped adults.

It will be understood that various details of the invention may be changed without departing from the scope of the invention. Furthermore, the foregoing description is for the purpose of illustration only, and not for the purpose of limitation—the invention being defined by the claims.

What is claimed is:

1. A child-resistant closure for containers having an externally threaded top portion and adapted for easy opening by elderly and handicapped individuals, said closure comprising:

an inner cap member having a top surface and an annular depending skirt with internal threads defined thereby for threadingly engaging the top portion of the container, the top surface of said inner cap member defining at least one upstanding locking lug element in the medial portion thereof and a plurality of drive lug elements positioned radially outwardly from said locking lug element and circumferentially spaced-apart; and an outer cap member having a top and an annular depending skirt loosely encompassing said inner cap an outer cap member having a top and an annular depending skirt loosely encompassing said inner cap member and being normally freely rotatable relative thereto in the closure loosening direction, the top of said outer cap member defining a plurality of inwardly extending drive finger elements adapted to slide over said drive lug elements when said outer cap member is rotated in the closure loosening direction and to engage said drive lug elements when said outer cap member is rotated in the closure tightening direction, and a resilient integral generally triangular wedge element adapted to be pushed inwardly and to pivot about an axis extending generally diagonally relative to the verticla aixs of said outer cap member so as to interlockingly engage said upstanding locking lug element of said inner cap member and to thereby permit rotation of said coupled inner and outer cap members in the closure loosening direction, said top of said outer cap further defining an aperture therein having substantially the diameter of a pencil and radially spaced-apart from said upstanding locking lug element so that when said outer and inner cap members are relatively rotated to a predetermined alignment one end of an elongate implement such as a pencil may be inserted through said aperture in a direction substantially perpendicular to said closure axis and into contact with said upstanding locking lug element so as to interlockingly couple said outer and inner cap members to facilitate rotation thereof in the closure loosening direction with the other end of the elongate implement.

2. The closure of claim 1 wherein said at least one upstanding locking lug element comprises two spaced-apart upstanding locking lug elements.

3. The closure of claim 2 wherein said two upstanding locking lug elements define an elongate passageway therebetween extending across the center of the top surface of said inner cap member.

4. The closure of claim 1 wherein said plurality of drive lug elements comprises four elongate locking lugs spaced equidistantly around the top surface of said inner cap member.

5. The closure of claim 4 wherein said elongate locking lugs each defines an inclined ramp along the length of one side thereof and a vertical wall along the length of the other side thereof, the vertical wall side being the leading side when said inner cap member is rotated in the closure loosening direction.

6. The closure of claim 1 wherein said plurality of inwardly extending drive finger elements comprises four drive finger elements circumferentially and equidistantly spaced-apart around the interior surface of the top of said outer cap member.

7. The closure of claim 1 wherein the top of said outer cap member substantially defines a frusto-conical shape.

8. The closure of claim 7 wherein said frusto-conical top of said outer cap member includes a wedge-defining section comprising a front extending generally vertically upwardly from the bottom of said frusto-conical top, a top extending from and being co-planar with the top surface of said frusto-conical top, and opposing sides extending upwardly from the conical portion of said frusto-conical top, said resilient wedge being formed from a first linear slot extending along the juncture of one side of said wedge-defining section with said frusto-conical top and a second linear slot extending from the uppermost end of said first slot diagonally outwardly across the top of said wedge defining section.

9. The closure of claim 8 wherein the front of said wedge-defining section is generally concave to accommodate the thumb or other finger of a user desiring to push the resilient wedge element inwardly so as to rotate the closure in the closure loosening direction.

10. The closure of claim 7 wherein said aperture is defined in the conical portion of said frusto-conical top of said outer cap member.

11. A child-resistant closure for containers having an externally threaded top portion and adapted for easy opening by elderly and handicapped individuals, said closure comprising:

an inner cap member having a top surface and an annular depending skirt with internal threads defined thereby for threadingly engaging the top portion of the container, the top surface of said inner cap member having two spaced-apart upstanding locking lug elements defining a passageway therebetween extending across the center thereof and a plurality of drive lug elements positioned radially outwardly from said locking lug element and circumferentially spaced-apart; and an outer cap member having a frusto-conical top and an annular depending skirt loosely encompassing said inner cap member and being normally freely rotatable relative thereto in the closure loosening direction, the top of said outer cap member defining a plurality of inwardly extending drive finger elements adapted to slide over said drive lug elements when said outer cap ember is rotated in the closure loosening direction and to engage said drive lug elements when said outer cap member is rotated in the closure tightening direction, and a resilient integral generally triangular wedge element adapted to be pushed inwardly and to pivot about an axis extending generally diagonally relative to the vertical axis of said outer cap member so as to interlockingly engage said upstanding locking lug elements of said inner cap member and to thereby permit rotation of said coupled inner and outer cap members in the closure loosening direction, said top of said outer cpa further defining an aperture therein having substantially the diameter of a pencil and radially spaced-apart from said upstanding locking lug elements so that when said outer and inner cap members are relatively rotated to a predetermined alignment one end of an elongate implement such as a pencil may be inserted through said aperture in a direction substantially perpendicular to said closure axis and into interlocking contact with said upstanding locking lug elements so as to interlockingly couple said outer and inner cap members to facilitate rotation thereof in the closure loosening direction with the other end of the elongate implement.

12. The closure of claim 11 wherein said plurality of drive lug elements comprises four elongate locking lugs spaced equidistantly around the top surface of said inner cap member.

13. The closure of claim 12 wherein said elongate locking lugs each defines an inclined ramp along the length of one side thereof and a vertical wall along the length of the other side thereof, the vertical wall side being the leading side when said inner cap member is rotated in the closure loosening direction.

14. The closure of claim 11 wherein said plurality of inwardly extending drive finger elements comprises four drive finger elements circumferentially and equidistantly spaced-apart around the interior surface of the top of said outer cap member.

15. The closure of claim 11 wherein said frusto-conical top of said outer cap member includes a wedge-defining section comprising a front extending generally vertically upwardly from the bottom of said frusto-conical top, a top extending from and being co-planar with the top surface of said frusto-conical top, and opposing sides extending upwardly from the conical portion of said frusto-conical top, said resilient wedge being formed from a first linear slot extending along the juncture of one side of said wedge-defining section with said frusto-conical top and a second linear slot extending from the uppermost end of said first slot diagonally outwardly across the top of said wedge defining section.

16. The closure of claim 15 wherein the front of said wedge-defining section is generally concave to accommodate the thumb or other finger of a user desiring to push the resilient wedge element inwardly so as to rotate the closure in the closure loosening direction.

17. The closure of claim 11 wherein said aperture is defined in the conical portion of said frusto-conical top of said outer cap member.

18. A child-resistant closure for containers having an externally threaded top portion and adapted for easy opening by elderly and handicapped individuals, said closure comprising:

an inner cap member having a top surface and an annular depending skirt with internal threads defined thereby for threadingly engaging the top portion of the container, the top surface of said inner cap member having two spaced-apart upstanding locking lug elements defining a passageway therebetween extending across the cetner thereof and a plurality of drive elements positioned radially outwardly from said locking lug element and circumferentially spaced-apart; and an outer cap member having a frusto conical top and an annular depending skirt loosely encompassing said inner cap member and being normally freely rotatable relative thereto in the closure loosening direction, the top of said outer cap member defining a plurality of inwardly extending drive finger elements adapted to slide over said drive lug elements when said outer cap member is rotated in the closure loosening direction and to engage said drive lug elements when said outer cap member is rotated in the closure tightening direction, and a wedge-defining section including a resilient integral generally triangular wedge element adapted to be pushed inwardly and to pivot about an axis extending generally diagonally relative to the vertical axis of said outer cap member so as to interlockingly engage said upstanding locking lug elements of said inner cap member and to thereby permit rotation fo said coupled inner and outer cap members in the closure loosening direction, said wedge-defining section comprising a front extending generally vertically upwardly form the bottom of said frusto-conical top, a top extending from and being co-planer with the top surface of said frusto-conical top, and opposing sides extending upwardly from the conical portion of said frusto-conical top, said resilient wedge being formed from a first linear slot extending along the juncture of one side of said wedge defining section with said frusto-conical top and a second linear slot extending from teh uppermost end of said first slot diagonally outwardly across the top of said wedge defining section, and said frusto-conical top of said outer cap further defining an aperture in the conical portion thereof having substantially the diameter of a pencil and radially spaced-apart from said upstanding locking lug elements so that when said outer and inner cap members are relatively rotated to a predetermined alignment one end of an elongate implement such as a pencil may be inserted through said aperture in a direction substantially perpendicular to said closure axis and into interlocking contact with said upstanding locking lug elements so as to interlockingly couple said outer and inner cap members to facilitate rotation thereof in the closure loosening direction with the other end of the elongate implement.

19. The closure of claim 18 wherein said plurality of drive lug elements comprises four elongate locking lugs spaced equidistantly around the top surface of said inner cap member.

20. The closure of claim 19 wherein said elongate locking lugs each defines an inclined ramp along the length of one side thereof and a vertical wall along the length of the other side thereof, the vertical wall side being the leading side when said inner cap member is rotated in the closure loosening direction.

21. The closure of claim 18 wherein said plurality of inwardly extending drive finger elements comprises four drive finger elements circumferentially and equidistantly spaced-apart around the interior surface of the top of said outer cap member.

22. The closure of claim 18 wherein the front of said wedge-defining section is generally concave to accommodate the thumb or other finger of a user desiring to push the resilient wedge element inwardly so as to rotate the closure in the closure loosening direction.

* * * * *